US005767774A

United States Patent [19]

Wright et al.

[11] Patent Number: 5,767,774

[45] Date of Patent: Jun. 16, 1998

[54] PATIENT BED EXIT MONITOR

[75] Inventors: Mack Wright, Jacksonville; George Roberts, Orlando; Bert Wechtenheiser, Ponte Vedra Beach, all of Fla.

[73] Assignee: Dwyer Precision Inc. a division of Wescom, Inc.

[21] Appl. No.: 839,300

[22] Filed: Apr. 17, 1997

[51] Int. Cl.[6] ..... G08B 23/00

[52] U.S. Cl. ..... 340/573; 128/782; 200/51.09

[58] Field of Search ..... 340/573, 548, 340/665, 544, 286.07; 128/846, 782; 200/51.09, DIG. 2, 82 R, 61.19

[56] References Cited

U.S. PATENT DOCUMENTS

| | | | |
|---|---|---|---|
| 3,104,293 | 9/1963 | Rendler | 200/51 R |
| 3,823,285 | 7/1974 | Dwyer | 200/81 H |
| 4,020,482 | 4/1977 | Feldl | 340/573 |
| 4,577,185 | 3/1986 | Andersen | 340/573 |
| 4,583,084 | 4/1986 | Henderson | 340/573 |
| 4,762,968 | 8/1988 | Hilton | 340/573 |
| 5,066,943 | 11/1991 | Demirel | 340/573 |
| 5,155,309 | 10/1992 | Dwyer | 340/573 |

*Primary Examiner*—Brent A. Swarthout
*Assistant Examiner*—Sihong Huang
*Attorney, Agent, or Firm*—Clifford A. Poff

[57] ABSTRACT

A system for monitoring a patient located on an item of furniture such as a bed is disclosed. The system includes a pneumatically actuated switch for providing a signal circuit to notify of undesired movement of the patient beyond a predetermined range. The pneumatic switch is responsive to a pneumatic pulse which is released from an armable pneumatic pressure generator having a spring loaded plunger and piston combination. The piston is maintained in an extracted and armed position through a releasable clip positionable within a notch in the piston and attached to the patient by a length of cord.

5 Claims, 4 Drawing Sheets

PATIENT BED EXIT MONITOR

BACKGROUND OF THE INVENTION

1. Field of the Invention

The present Invention relates generally to patient alert systems. In particular, the present invention relates to a monitor which is connectable to a typical nurse call system to notify care givers automatically when the patient has moved beyond a certain range and may need assistance.

2. Description of the Prior Art

It is known in the prior art to provide a system for alerting health care providers, such as nurses, when a patient moves beyond a certain range in a bed thereby indicating that assistance may be necessary, as disclosed in U.S. Pat. Nos. 4,577,185 to Andersen; 4,583,084 to Henderson; 5,066,943 to Demirel; and 4,020,482 to Feldl.

The typical setting for such a system will be in a hospital or other similar health care facility. These facilities frequently utilize certain gases, most notably oxygen, which present the possibility of combustion in an atmosphere containing sufficient concentration of the gas. In such an environment, it has been found that the use of electrical switches in devices which may be located near patients, such as nurse call signaling devices, is undesirable because of the possibility of arcing within a combustible environment. This led to the development of switches, such as the pneumatic switches disclosed in U.S. Pat. No. 3,823,285 to Dwyer, having a construction which limits the possibility of arcing, thereby increasing the applicability of the switch to include use within combustible environments.

Many of the prior art monitoring systems incorporate signaling devices in which the conductive portions forming the signal circuit are not protected against arcing. For example, in the Andersen system, removal of a conductive jack connected to the patient from a receptacle triggers a switch for producing a signal. In the Henderson system, a jack connected to a patient provides for the mechanical opening of an electrical circuit within the receptacle. Removal of the jack from the receptacle results in closing of the circuit and generation of a signal. And in the Demirel system, the prongs of a garment clip are electrically conductive and a signal circuit is kept open by the presence of patient clothing between the prongs of the clip. Removal of the clip from the clothing results in closing of the electrical circuit and generation of a signal. None of these systems, namely the Andersen, Henderson, and Demirel systems, protect against arcing and are therefore not usable in patient environments in which oxygen, or other combustible materials, are being utilized.

The Feldl bed monitoring system incorporates a pneumatically actuated signal for alerting upon the exiting of a patient from the bed. The system includes an air bag, located beneath the mattress, which is connected to a normally closed pressure switch by tubing. The pressure switch is maintained in the open position by pressure resulting from the weight of the patient on the mattress. Reduction in pressure below a predetermined level results in closing of the switch and generation of a signal. Such a system, which is activated by a certain reduction in pressure, lacks a precise triggering event which is desirable in a monitoring system, and is susceptible to false actuation. For example, pressure reduction may result from any leak developing at any point in the necessarily sealed quantity of air extending from the bag, through the hosing, to the normally closed pressure switch. Also shifting of the patient within the bed not related to exiting from the bed could result in variation in the pressure transferred to the monitoring system.

What is needed is a patient monitoring system which incorporates a signal generating construction which may be used in a combustible environment and which includes a reliable, and precise, triggering mechanism.

Accordingly, therefore it is an object of the present invention to provide a patient monitoring system incorporating a pneumatically actuated switch for providing a signal circuit which is usable in any situation in a patient care facility, including use in potentially combustible atmospheres such as that encountered when oxygen is in use.

It is yet a further object of the present invention to provide a patient monitoring system incorporating a triggering mechanism which is reliable and precise thereby insuring against false activation of the system.

SUMMARY OF THE INVENTION

According to the present invention, there is provided a system for monitoring a patient situated on an item of furniture. The system includes an armable pneumatic pressure generator having a releasable trigger for generating a pneumatic pulse, the generator being stationarily mountable proximate to a patient bearing area of such an item of furniture; a pneumatic hose having a first end connected to the pneumatic pressure generator and an opposite second end; a patient attachment for connecting the trigger of the pneumatic pressure generator to such a patient, the attachment having a length such that the generator will be actuated upon movement of the patient outside of a predetermined radius from the pneumatic pressure generator; and a pneumatically actuated switch connected to the second end of the pneumatic hose, the switch responsive to a released pneumatic pulse from the pneumatic pressure generator to indicate such movement of a patient outside a predetermined radius from the pneumatic pressure generator.

DETAILED DESCRIPTION OF THE PREFERRED EMBODIMENTS

Figure 1:
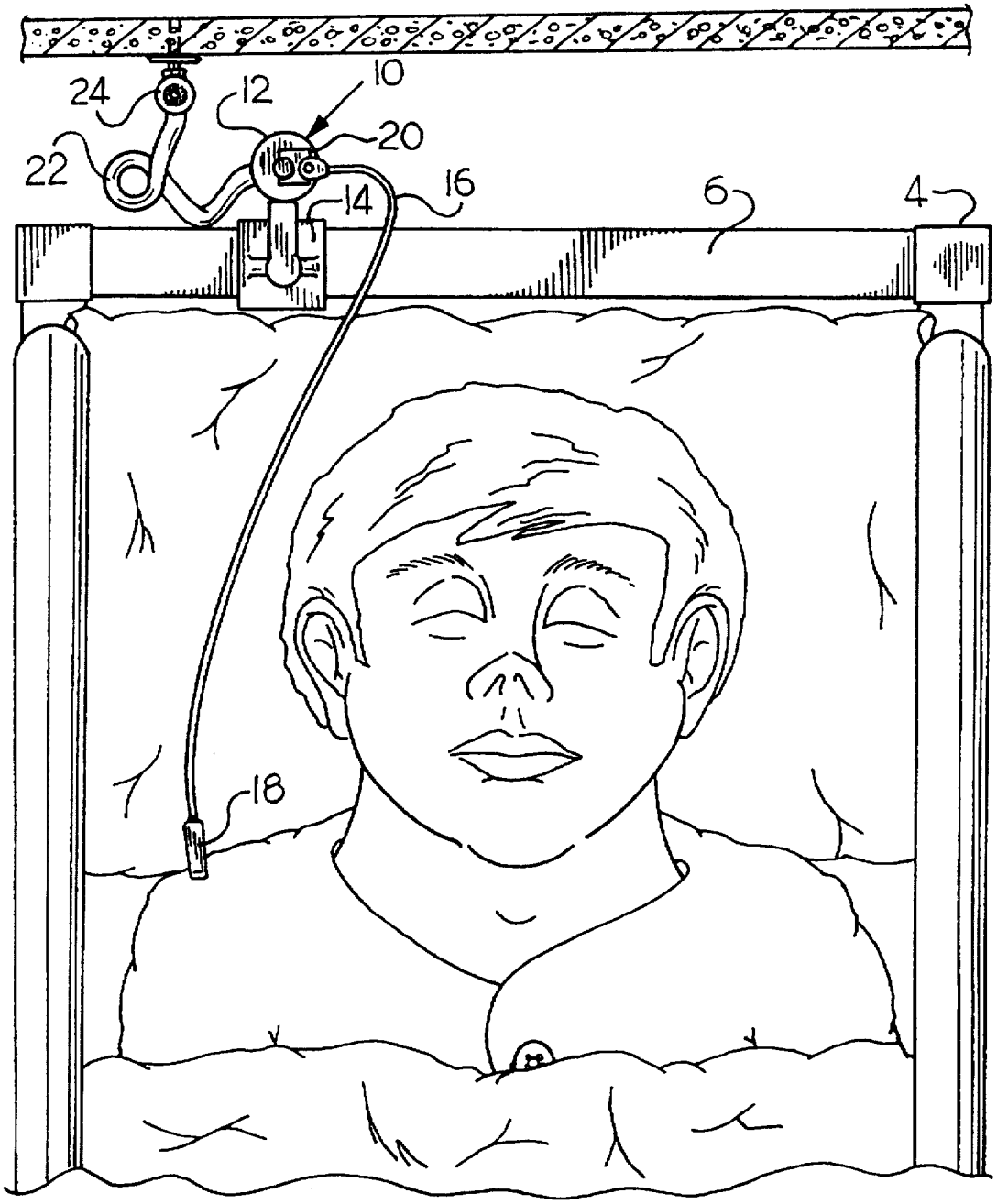
FIG. 1 is a plan view of a patient bed incorporating a monitoring system according to the present invention.
Figure 2:
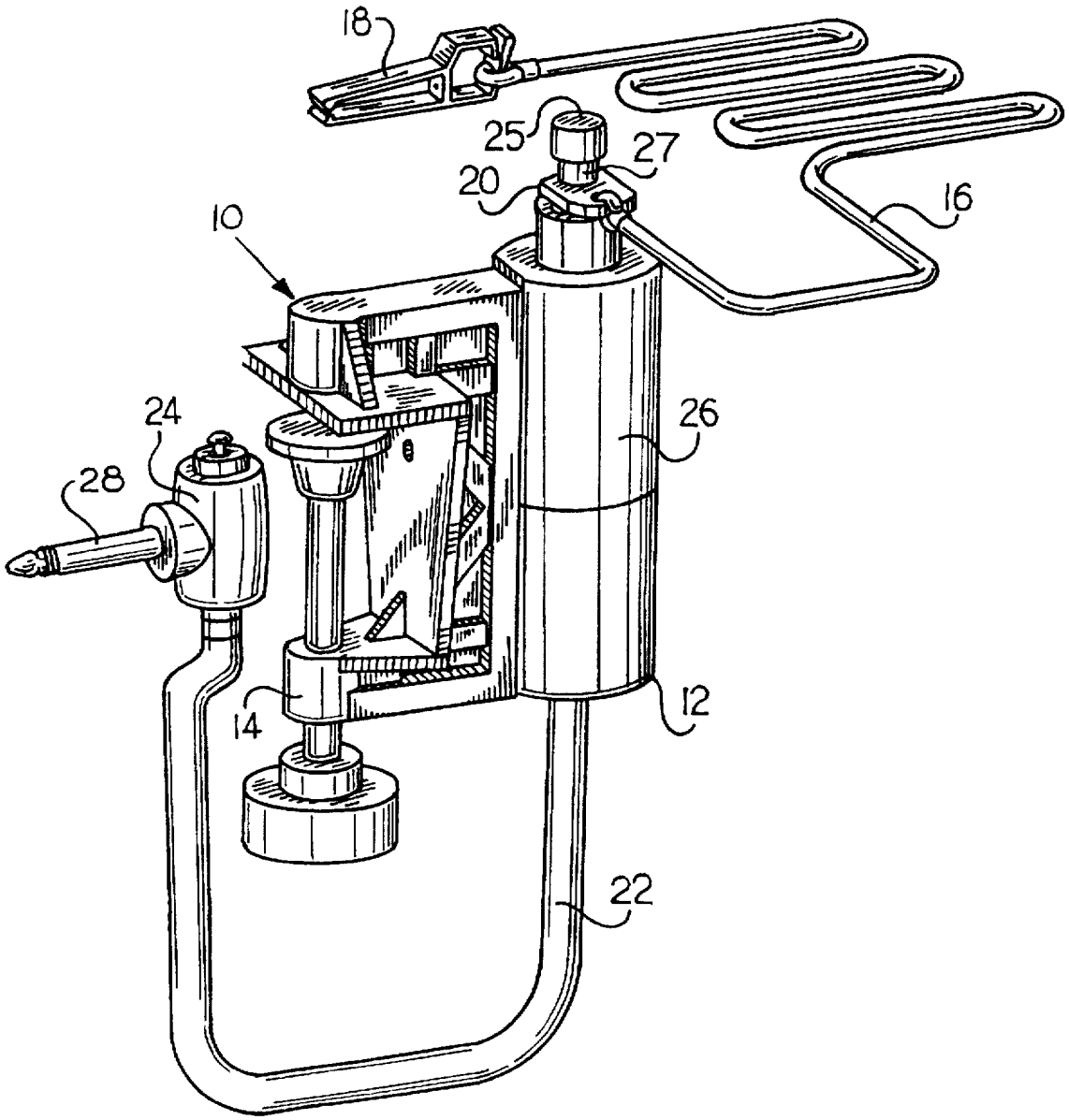
FIG. 2 is a perspective view of the monitoring system of FIG. 1.

FIGS. 1 and 2 show a system 10 according to the present invention for monitoring a patient who is situated on an item of furniture such as a bed or chair and automatically signaling upon movement of the patient beyond a certain range. Referring to FIG. 1, there is shown a plan view of a patient lying in a patient bed 4 having a cross rail 6. The monitor system includes a pneumatic pressure generator 12 which is attached to the bed cross rail 6 through clamp mounting portion 14. A length of attachment cord 16, such as made of nylon, connects at one end to the patient through garment clasp 18 and at an opposite end to the generator 12 through trigger clip 20. The length of cord is most preferably 5 feet. A length of pneumatic hose 22 connects at one end to the generator 12 and at an opposite end to pneumatic switch 24 which is shown engaging a wall receptacle.

Turning to FIG. 2, the perspective view shows in greater detail the construction of the monitor system 10. The pneumatic pressure generator 12 has an armable piston 25 extending from an opening in a housing 26, the internal construction of the generator to be discussed in greater detail below. The piston 25 is maintained in an armed position by the U-shaped trigger clip 20 which fits within a groove 27 in the piston 25. The clip 20 functions as a trigger for activation of the pneumatic pressure generator upon the removal of the clip from the groove 27 of piston 25.

The clamp mounting portion 14, seen in greater detail in FIG. 2, extends from the housing 26 of the pneumatic pressure generator. The construction of the clamp is useful for mounting the generator to a variety of locations on the patient bed to be monitored.

The garment clasp 18, attached to the end of the attachment cord 16 opposite from the trigger clip 20, may be attached to the clothing worn by the patient. The pneumatic hose 22, extending from the housing 26 opposite from the piston 25, conveys a released pneumatic pressure pulse from the generator 12 to the pneumatically actuated switch 24 attached to the end of the hose opposite from the pneumatic pulse generator. The pneumatic switch 24 is per se well known in the art, as disclosed in U.S. Pat. No. 3,823,285 to Dwyer.

The monitor shown in FIG. 1 and 2 functions in the following manner. With the pneumatic pressure generator attached through the mounting clamp to a suitable location of the bed, such as a headboard or railing, the pneumatic switch 24 is connected through plug 28 to a conventional nurse call signal system, or other suitable alarming network. The monitor is then armed by extracting the piston 25 from housing 26 and placing the trigger clip 20 in the piston groove 27 to keep the piston 25 in an extracted position with respect to the housing 26. Once the patient has been positioned in the bed 4, the attachment cord 16 is connected to the patient through the garment clasp 18.

With the monitor now in the armed condition, were the patient to attempt to leave the bed, an activation barrier defined by a radius between the mounted pulse generator and the attachment cord in an extended condition would be reached. Further movement by the patient beyond the activation barrier will result in the removal of the trigger clip 20 from the armed piston 25 causing retraction of the piston within the housing 26 of the pneumatic pressure generator 12 and release of a pneumatic pulse to the switch 24. The switch 24 is responsive to the pneumatic pulse to send a signal through the plug 28 to a nurse call system to indicate that the patient has moved beyond the activation barrier and may need assistance.

Figure 3:
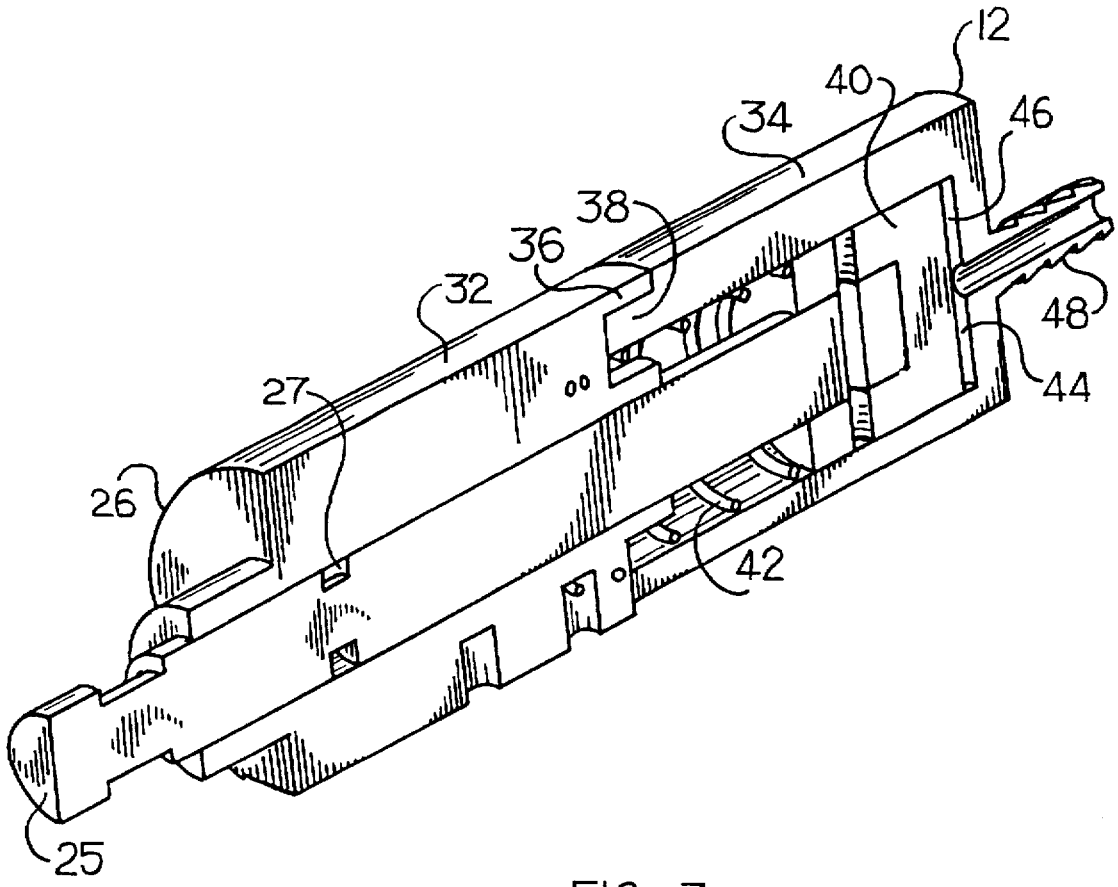
FIG. 3 is a sectional perspective view of a pneumatic pressure generator of the system of FIG. 1.

Turning to FIG. 3, there is shown a perspective sectional view of the pneumatic pressure generator 12 of FIG. 1. The housing 26 includes an upper housing 32 having an internal opening through which piston 25 extends. The housing 26 also includes a lower housing 34 which is attached to the upper housing through overlapping sections 36 and 38 of the upper and lower housings, respectively. Methods of attachment of the upper and lower housings include an interference fit between the overlapping sections, or by pinned or bolted locations around the circumference of the overlapping portions, or by a combination of both.

As seen in FIG. 3, the lower housing 34 has an internal opening into which the piston extends to a connection with a plunger 40. A spring 42 located within the opening in the lower housing acts between the plunger 40 at one end and the upper housing at an opposite end to provide a force tending to return the piston within the housing after the piston has been extracted for arming. When the trigger clip 20 of FIGS. 1 and 2 is removed from the groove 27, the spring 42 forces the piston 25 and the attached plunger 40 back into the internal opening in the lower housing. This creates a pressure pulse between an edge surface 44 of plunger and an end face 46 of the lower housing which exits the pressure generator through nozzle 48 to the hose 22 of FIG. 1 which is connected to the nozzle. The plunger must be free to slide within the opening in the lower housing but must be sufficiently close fitting so that an air pulse can be generated in front of the plunger face 46. The required tolerance is not required to be extremely close as the pneumatic switch 24 is responsive to low level pressure pulses.

Figure 4:
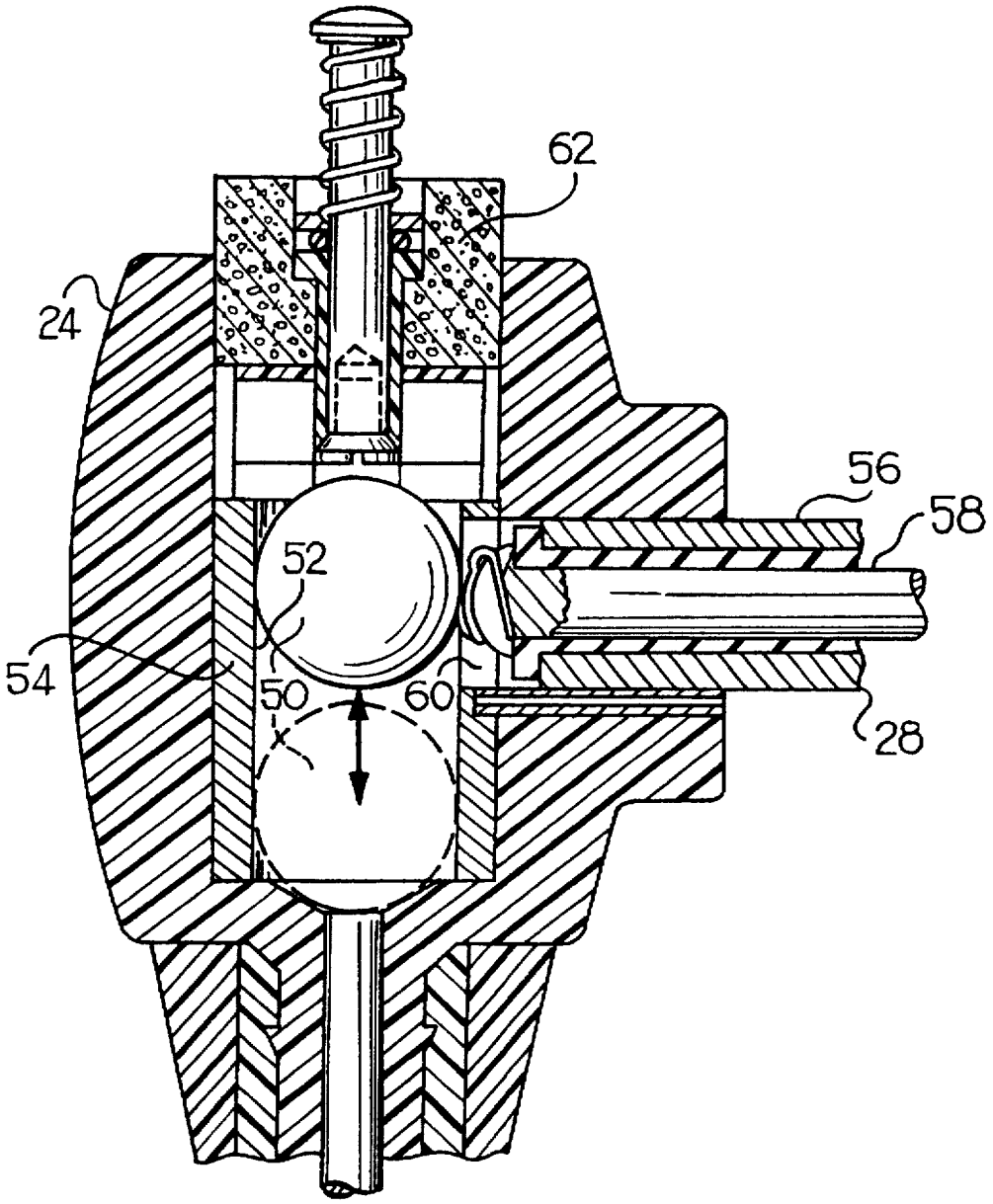
FIG. 4 is a sectional view of a pneumatic switch of the system of FIG. 1.

Turning to FIG. 4, the construction of the pneumatic switch 24 of FIGS. 1 and 2 is seen in greater detail. The construction of the switch was described in U.S. Pat. No. 3,823,285 and in particular in FIG. 6 and the associated description. The switch includes an electrically conductive ball 50 contained within a closely toleranced bore 52 of an electrically conductive sleeve 54. The electrically conductive sleeve 54 is in electrical contact with an external first conductor portion 56 of plug 28. An internal second conductive portion 58 of plug 28, electrically insulated from the first portion 56, extends through an opening 60 in the conductive sleeve 54 allowing for temporary contact between the ball 50 and the second conductive portion 58 as the ball is driven upwards in the sleeve 54 in response to a pulse of air delivered from the generator 12 via the hose 22. This temporary contact closes an electrical circuit normally open sending a signal through the plug 28 to a nurse call system to which the plug is connected.

The porous filter 62 provides for venting of air on the downstream side of the conductive ball 50 allowing the pressure pulse on the upstream side of the ball from the filter to drive the ball upwards past the second conductive portion 58.

During movement of the conductive ball 50 within the sleeve 54, the second conductive portion 58 of the jack which extends into the bore of the sleeve causes contact between the ball 50 and the surface of the bore 52. Thus, the surface of the ball is pressed into intimate wiping contact with the surfaces of the bore and the second conductive portion of the jack. This is a key feature of the switch which eliminated problems associated with other switches. Wiping of the various surfaces against one another cleans the surfaces and prevents the deposition of sulfides or other contaminates thereon which would deleteriously affect the conducting properties of the surfaces and result in arcing. Arcing, which not only presents the possibility of combustion in explosive environments, also would quickly erode the surfaces, particularly plated surfaces, thereby destroying the sensitivity and reliability of the device. For example, when silver plated surfaces are wiped clean, a pneumatic pressure of only about two inches of water is required to raise the ball in the sleeve bore. However, if the silver plating is eroded away, a pneumatic pressure of as much as about twelve inches of water is required.

Although FIG. 1 shows an embodiment of the present invention used in connection with a patient located on a bed, it should be noted that the system of the present invention would be equally suited for use in connection with a patient located on other items of furniture such as a chair, for example. When a chair is used to support the patient, the generator will be attached by the clamp monitoring portion to a chair rail.

While the present invention has been described in connection with the preferred embodiment of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

We claim:

1. A system for monitoring a patient located on an item of furniture, the system including:

(a) an armable pneumatic pressure generator having a releasable trigger for generating a pneumatic pulse, the generator being stationarily mountable proximate to a patient bearing area of such an item of furniture;

(b) a pneumatic hose having a first end connected to the pneumatic pressure generator and an opposite second end;

(c) a patient attachment for connecting the trigger of the pneumatic pressure generator to such a patient, the attachment having a length such that the generator will be actuated upon movement of the patient outside of a predetermined radius from the pneumatic pressure generator; and (d) a pneumatically actuated switch connected to the second end of the pneumatic hose, the switch responsive to a released pneumatic pulse from the pneumatic pressure generator to indicate such movement of a patient outside a predetermined radius from the pneumatic pressure generator.

2. The system according to claim 1 wherein the pneumatic pressure generator includes:

(a) a housing having an internal cavity;

(b) an elongated piston having a first end portion extendable from the housing and an opposite second end;

(c) a plunger slidably contained within the cavity of said housing and attached to the second end of the piston, the plunger having a forward surface for formation of the pneumatic pulse; and (d) a spring contained within the cavity and having a first end in contact with the plunger and an opposite second end in contact with the housing such that extraction of the first end portion of the piston from the housing results in compression of the spring and formation of potential energy for arming of the pneumatic pressure generator.

3. The system according to claim 2 wherein the extendable first end portion of the piston has a notch around at least a portion of an outer periphery and wherein the trigger includes a u-shaped clip positionable within the notch such that the clip will maintain the piston in an extracted position with respect to the housing thereby arming the generator and wherein the removal of the u-shaped clip from the first end portion of the piston will result in conversion of the potential energy stored in the spring into kinetic energy in the form of retraction of the piston within the housing causing the formation of the pneumatic pulse on the forward surface of the plunger.

4. The system according to claim 3 wherein the patient attachment is a length of cord having a first end attached to the u-shaped clip of the trigger and an opposite second end attached to a garment clip which is attachable to clothing of such a patient.

5. The system according to claim 1 wherein the pneumatically actuated switch includes:

(a) an electrically conductive sleeve having an internal bore;

(b) an electrically conductive ball which is slidably contained within the bore of the sleeve, the ball being slidable in response to a pulse of air from the pneumatic pressure generator; and (c) a jack portion connectable to a nurse call system having a first electrically conductive outer portion in contact with the sleeve, the jack outer portion having an internal cavity in which a second electrically conductive portion is contained such that the second portion is electrically insulated from the first portion, the second portion having an end portion which communicates with the internal bore of the sleeve such that sliding of the ball in response to a pulse of air results in momentary contact of the ball with the second conductive portion of the jack thereby causing momentary electrical connection between the first and second jack portions.

* * * * *